United States Patent [19]

Thourson et al.

[11] Patent Number: 4,583,489

[45] Date of Patent: Apr. 22, 1986

[54] METHOD FOR MAKING DUPLICATE XERORADIOGRAPHIC IMAGES

[75] Inventors: Thomas L. Thourson, La Canada; David J. Wolfe, Pomona, both of Calif.

[73] Assignee: Xerox Corporation, Stamford, Conn.

[21] Appl. No.: 731,182

[22] Filed: Apr. 29, 1985

[51] Int. Cl.[4] ..... G03G 15/08; G03G 15/16

[52] U.S. Cl. ..... 118/653; 118/659; 430/126

[58] Field of Search ..... 430/126, 31; 118/653, 118/659

[56] References Cited

U.S. PATENT DOCUMENTS 4,218,619 8/1980 Yang et al. ..... 250/315.2

4,394,432 7/1983 Nishikawa ..... 430/120

*Primary Examiner*—John D. Welsh

*Attorney, Agent, or Firm*—Robert E. Cunha

[57] ABSTRACT

A xerographic system which makes two, or more, copies for each exposure by developing the image twice. This can be done by either providing two developing, drying and transfer stations within the system, or by reversing the direction of the exposed plate so that it is processed twice by these stations. This technique is possible because a large part of the image remains on the plate after the first development cycle.

6 Claims, 9 Drawing Figures

METHOD FOR MAKING DUPLICATE XERORADIOGRAPHIC IMAGES

This is a method and apparatus for making duplicate xerographic images from one exposure of a xerographic plate, and specifically describes an automatic hardware system for making a second image either by reversing the direction of the plate after the first development and repeating the development cycle, or by providing the system with two development stations, through which a single plate is processed.

BACKGROUND OF THE INVENTION

U.S. Pat. No. 4,346,983 describes an automatic system for developing cassettes comprising small xerographic plates for use in intraoral dental radiography. The cassette is inserted into the system which removes the plate from the cassette, developes an image through the use of toner supplied by a liquid fountain, dries the plate, transfers the image to an adhesive film, and then discharges and stores the plate for the next use.

A problem with this system is that the dentist frequently must have two copies of the set of images, one for the patient's file, the other for the insurance company. When photographic film is used for these images, a duplicate can be made simply by providing two photographic films on each cassette. However, xerographic plates are too large to be used this way. Presently, a duplicate image is made from a xerographic plate by making contact prints of the images on the adhesive film. An automatic method of making duplicate images is required.

SUMMARY OF THE INVENTION

It has been found that a xerographic plate retains its charge after development and can be used again to make a duplicate image. An automatic system for producing an image from a xerographic plate can therefore be modified to make an additional print by having two developing, drying and transfer stations. In this case, the plate, which still has a residual electrostatic image, can be developed again to form a duplicate copy.

An alternate method is to process the plate through the developing, drying and transfer stations a first time, disengage the transfer station, discontinue the flow of liquid to the development station, withdraw the plate back to its starting point, and process the plate a second time through the same stations. This method would allow the production of any number of images without increasing the number of stations in the system.

DETAILED DESCRIPTION OF THE INVENTION

Figure 1:
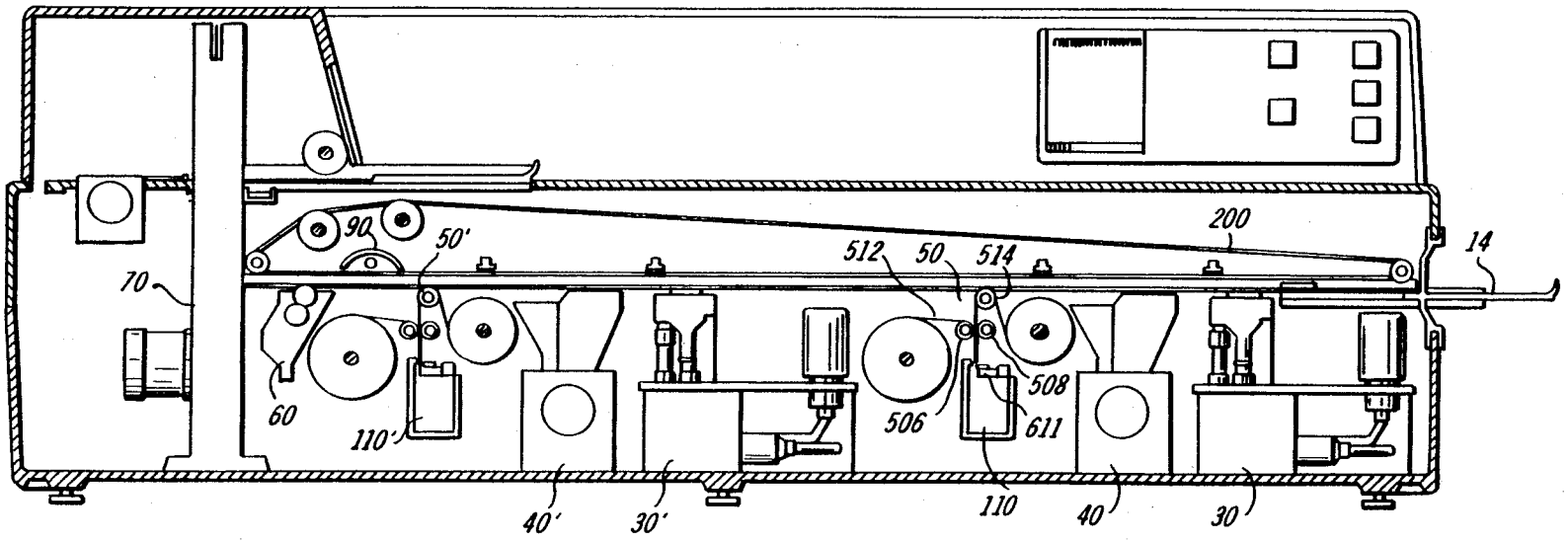
FIG. 1 is a simplified drawing showing a system having duplicate development, drying and transfer stations.

A straight forward way to obtain a second image from a single exposure is to duplicate the essential processing subsystems. This is illustrated in FIG. 1. In this embodiment, the development station 30, the drying station 40 and the transfer station 50 are duplicated. The cassette is inserted in coin slot 14. The coin slot is pushed into the system. This activates the system and a pusher attached to cable 200 removes the plate from the cassette and pushes it down the plate path. The plate passes over development station 30 where pigmented toner particles are deposited in an imagewise fashion over the plate. The plate then passes over drying station 40 to remove excess fluid from the plate. The plate then moves to the transfer station where the toner image is transferred by rolling contact to an adhesive transfer tape 514. The transparent tape is then laminated to an opaque backing tape 512 by passing the tapes between two pressure rolls 506, 508.

The laminated tapes are driven by the pressure rolls 506, 508 into output chamber 110 and cut to a suitable length by cutter 611. This image can then be retrieved by the operator. At this stage sufficient electrostatic image remains on the plate so that it can be redeveloped and a second, duplicate image obtained. To accomplish this, a second set of the essential subsystems are provided. The plate continues along the plate path through the second development station 30', the second drying station 40' and the second transfer station 50'. All of these stations function in like manner to the first set of systems to deliver a duplicate image to second output chamber 110'. The plate then goes through the ultraviolet sterilization station 90 and the cleaning station 60 and into the elevator 70 for reuse. If only a single image is required, the first or second set of stations can be disengaged.

Figure 2:
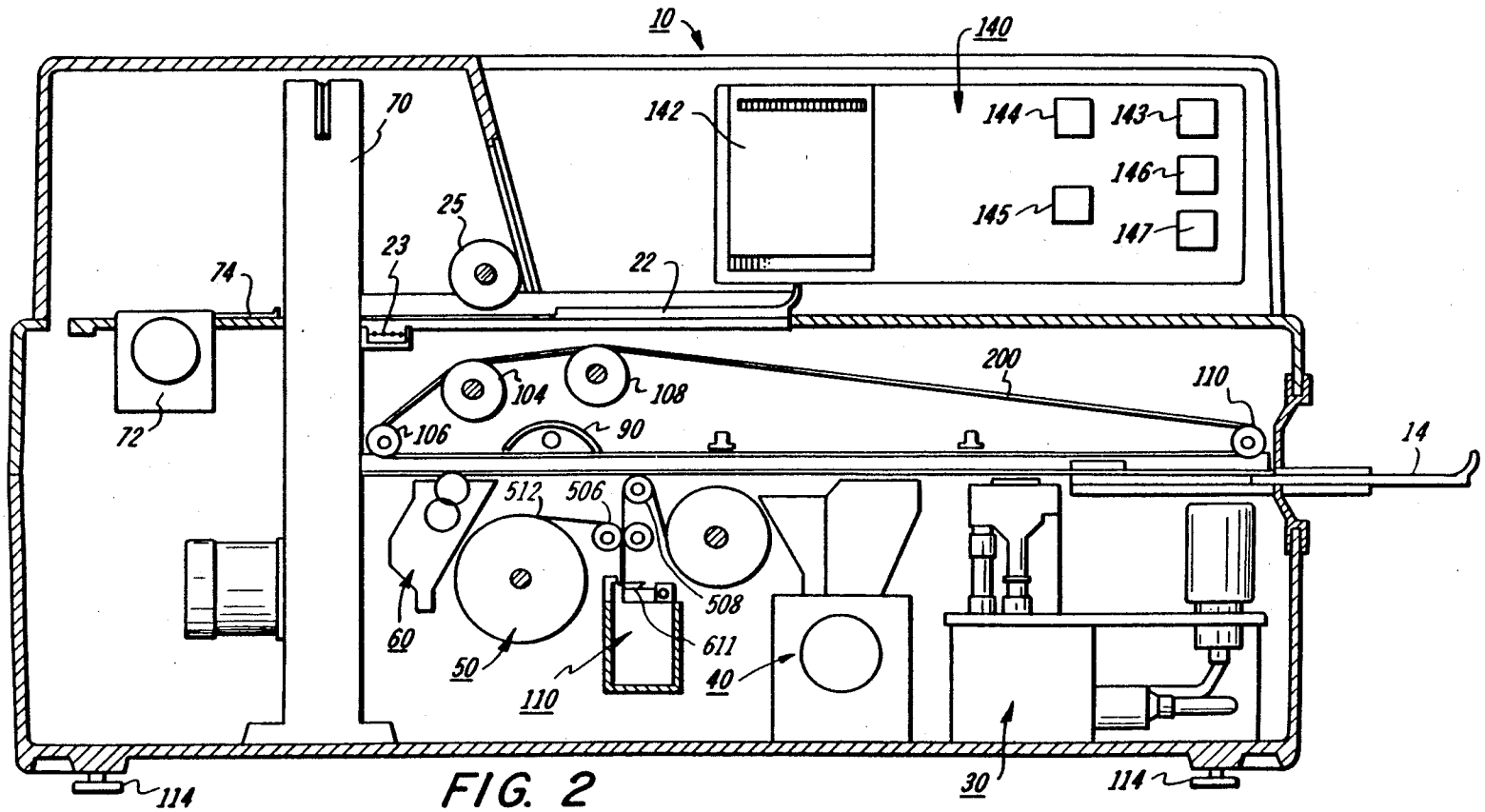
FIG. 2 is a simplified drawing showing a system having a single set of stations, where the plate is developed twice by returning it through the development cycle a second time.

An alternate embodiment is shown in FIG. 2. The cassette is inserted in coin slot 14. The coin slot is pushed into the system. This activates the system and a pusher attached to cable 200 removes the plate from the cassette and pushes it down the plate path. The plate passes over the development station 30 where pigmented toner particles are deposited in an imagewise fashion over the plate. The plate then passes over the drying station 40 to remove excess fluid from the plate. The plate then moves to the transfer station 50 where the toner image is transferred by rolling contact to an adhesive transparent tape 514. The transparent tape is then laminated between two pressure rolls 506, 508 to a white translucent backing tape 512. The laminated tapes are driven by the pressure rolls 506, 508 into the output chamber 110 and cut to a suitable length by cutter 611. The image can then be retrieved by the operator. At this stage sufficient electrostatic image remains on the plate so that it can be redeveloped and a second, duplicate image obtained. To accomplish this the transfer station 40 is lowered so that it is disengaged from the plate path and the fluid flow into the development station 30 is turned off. The motion of the plate is reversed and the plate is returned to the development station 30. The fluid flow is then restarted, the drying station is turned on and the transfer station is reengaged with the plate path. The pusher then propels the plate back down the plate path through the development, drying and transfer stations to create a second image in the same manner as the first image. The plate then goes through the ultraviolet sterilization station 90 and the cleaning station 60 and into the elevator 70 for re-use. If only a single image is required, the duplicate image mode can be inactivated.

Also shown in FIG. 2 is motor 72 utilized to drive an output pusher rod, or arm 74 which is utilized to push a selected photoconductive plate stored in elevator 70 into the carrier portion inserted into output slide 22. Corona is utilized for charging the photoconductive plate as it is being forced onto the carrier portion and, in the preferred embodiment, is provided by a multi-wire scorotron. Leveling feet 114 (only two shown) may be provided to adjustably support the processor 10 on a work area selected by the operator. The drive mechanism 100 which drives the photoconductive member includes cable 200 and pulleys 102, 104, 106 and 108. A section in control panel 140 both stores large and small carriers (two different sizes are provided, the larger size corresponding to No. 2 dental film, the smaller size corresponding to No. 1 dental film) in storage 142; a processor 10 power on panel 143 and touch panels 144, 145, 146 and 147 showing the process status (i.e., the number of plates remaining in elevator station 70), previous plate request, bite wing or pericipical mode, plate status, and tape cutter.

Figure 3:
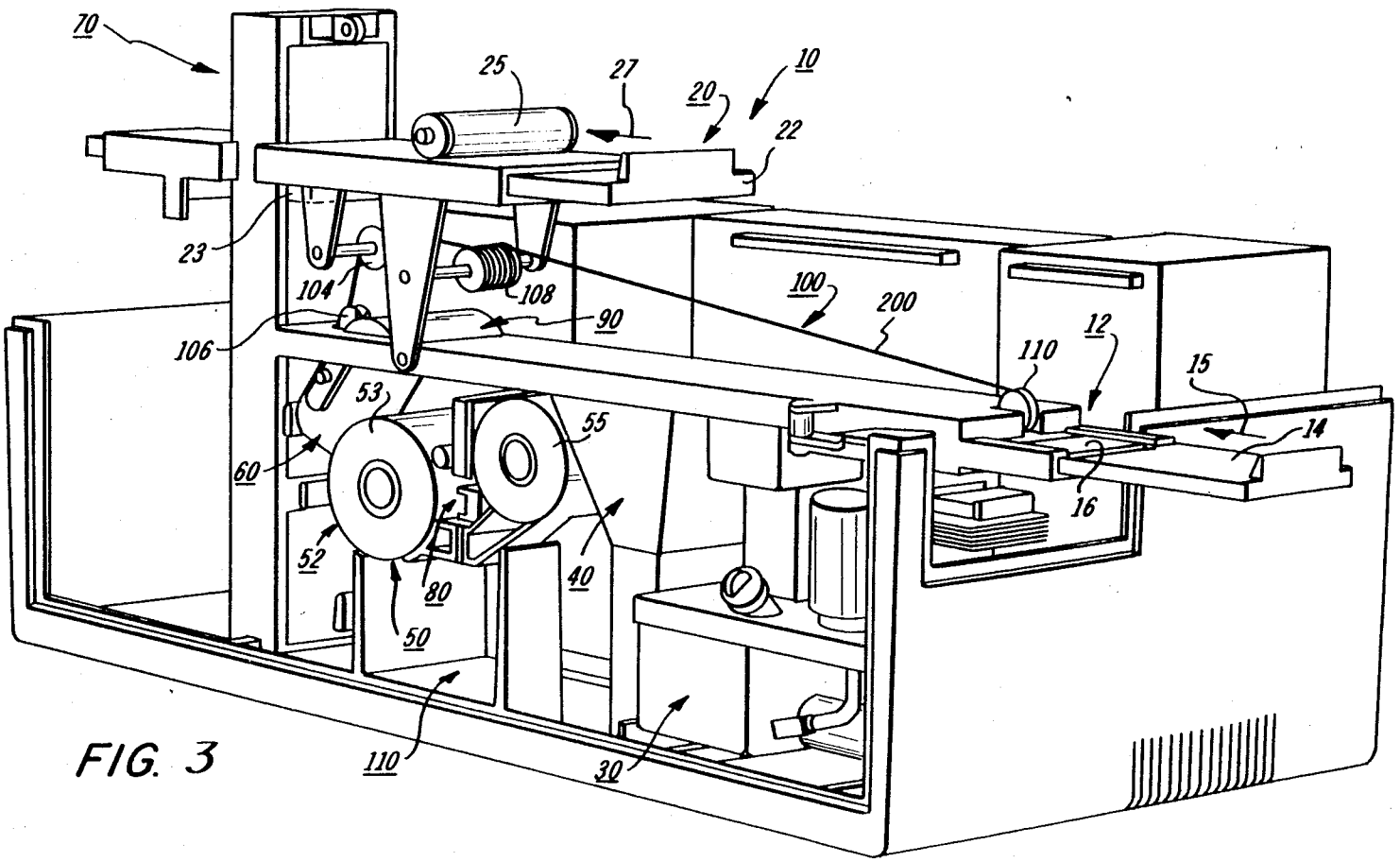
FIG. 3 is a perspective view of the system.

FIG. 3 is a perspective view with some covers removed of the processor portion 10 of the intraoral dental system in accordance with the teachings of the present invention. The processor input station 12 comprises a slide type mechanism 14 (similar to a coin slot in a vending machine) shown with a cassette 16 ready for development and partially inserted into the processor 10. The output station 20 also comprises a slot type mechanism 22 wherein the carrier portion of the cassette 16 is inserted into the processor 10 to receive a charged photoconductive plate and a charging unit 23, unit 23 comprising a U-channel having corona and screen wires formed therein in accordance with standard xerographic scorotron charging techniques. An adhesive coated cylindrical roll 25 is provided as shown to pick up any lint which may be on or in the carrier portion of the cassette 16 as the slide mechanism is pushed into position.

The development station is indicated by reference numeral 30, the drying station by reference numeral 40, the transfer station by reference number 50 (including the tape and backing material cartridge 52), the cleaning station by reference numeral 60, the elevator station by reference numeral 70 and the cutting station by reference numeral 80. The sequence of making an image is as follows: the carrier member portion of cassette 16 is inserted into the output station slide mechanism 22, the slide being pushed by an operator in the direction of arrow 27. A pusher motor (not shown), the pusher motor shaft being mechanically coupled to a pushing mechanism associated with the elevator station 70, is activated whereby a selected photoconductive member in the elevator station 70 is forced out from an elevator slot in a direction such that the surface of the photoconductive member is exposed to the scorotron 23 as it is pushed into the carrier portion of the cassette 16. The charged plate, it should be noted, is equivalent to an unexposed dental film utilized in present intraoral examinations. In the system of the present invention, since the photoconductive plate member and carrier will be reused, the cassette 16 is inserted into a plastic bag before insertion into the patient's mouth to protect the cassette from saliva and bacteria (the carrier portion of the cassette portion is sterilized outside the process 10). After the plate member is exposed to X-rays (generated by any standard X-ray unit, such as the General Electric 1000 dental X-ray unit, manufactured by the General Electric Company, Milwaukee, Wis.), the bag is discarded and the cassette is placed in the input slot of slide 14, slide 14 being pushed in the direction of arrow 15 to activate the development process. The plate member is then removed from the cassette 16 by a second drive mechanism 100.

An ultraviolet lamp 90 is provided for exposing the back surface of the photoconductive member portion of cassette 16 after transfer occurs for sterilization purposes prior to being inserted into a patient's mouth although the cassette is preferably enclosed by a plastic bag.

Initially, the photoconductive plate member is pushed across development station 30 wherein the latent electrostatic charge pattern on the plate surface is developed electrophoretically.

Development takes place at about 0.5 inches or 1.27 cm/sec., the plate surface being exposed to a liquid toner fountain. After the image is developed, the plate is then pushed to the drying station 40, drying being necessary since a wet toner image on the plate cannot be successfully transferred using the adhesive tape transfer technique utilized at the transfer station 50. An angled airknife is provided, the directed air stream squeeging most of the excess developer to one side where it is absorbed by absorbing pads. To insure that the remaining toner image is dry, forced hot air is subsequently blown onto the plate. This drying function takes place as the plate continues to move through processor 10. The continually pushed dried plate is next brought to the transer station 50. Cartridge 52, located at transfer station 50 in processor 10, contains both backing material, which is translucent, and the adhesive transfer tape in separate storage compartments 53 and 55, respectively. The plate surface having the dried toner image thereon is first brought into contact with the adhesive surface of the transfer tape. The tape is rolled onto the plate by a pressure roller (not shown) and the toner image is lifted off by virtue of the tacky material on the tape surface. Fixing of the image takes place by laminating the adhesive side of the tape having the toner image affixed thereto, to the backing materal, the toner image being sandwiched between the transfer tape and the backing material. If the operator of processor 10 elects to view individual images, a knife at the cutting station 80 is activated which cuts off the image from the continuous length of the laminated sandwich, the cut image falling into output tray 110 the photoconductive member is then exposed to the ultraviolet lamp 90. The plate next enters into cleaning station 60 where the plate surface contacts a donor roller which is partially submerged in the fluid solvent used in the developer fluid to mix the developer, thereby removing any residual image. The cleaned plate is then pushed into a storage slot in the elevator 70 for subsequent reuse. The elevator 70 is controlled by a microprocessor in a manner such that the plate stored in the elevator the longest time period is the one pushed into a corresponding sized carrier presently inserted into the output station slide 22.

Figure 4:
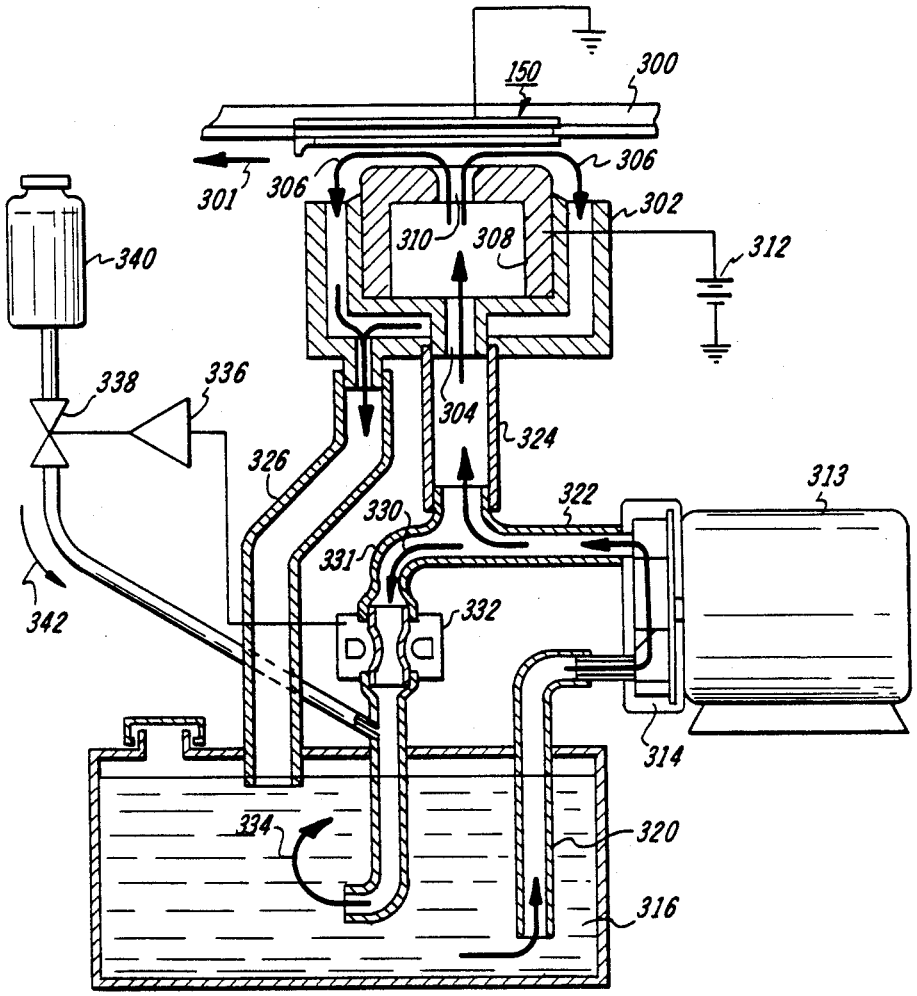
FIG. 4 is a schematic view of the development station.

Referring to FIG. 4, a schematic representation of the liquid development system utilized in the present invention is illustrated. The photoconductive plate member is pushed along the plate track in the direction of arrow 301. In the illustration, the photoconductive plate surface, having the latent electrostatic charge pattern formed thereon, faces downward towards the development system as it moves through the processor 10.

A rectangular shaped containment member 302 having an aperture 304 provides the liquid toner developer/flow (illustrated by arrows 306). The flow 306 is first directed through rectangular shaped development electrode 308 having an aperture 310 formed therein. A source of high voltage 312 is connected to development electrode 308 as shown.

The latent charge image on the surface of photoconductive member 150 is made visible preferably through an electrophoretic development process using liquid development as herein described. Electrophoretic development may be defined as migration to and subsequent deposition of toner particles suspended in a liquid on an image receptor under the influence of electrostatic field forces. Electrophoretic developers are typically suspensions of very small toner particles in a dielectric fluid, typically an isoparafinic hydrocarbon. Depending on the materials used and the formulation of the suspension, the toner particles may take on a positive or negative charge. In typical xeroradiographic development situations, since only fringe fields are extending into the developer, development will normally occur only at the edge of a change in object density. Therefore, the field is modified to achieve also broad area development to the surface of the photoconductive plate 150. Biased electrode 308 superimposes a uniform electric field on the fringe field and the combined development field geometry provides for the movement and deposition of the toner particles.

The use of biased development electrode 308 biased positively in a suspension of toner particles having the same polarity as the charge image allows for negative image development which is the same development scheme used on X-ray film. As is well-known, edge enhancement and deletion as utilized in the present invention are the most important characteristics in xeroradiographic imaging and are primarily responsible for the quality advantages of xeroradiographic images over film images. The development field and thus the degree of enhancement, deletion, broad area contrast and edge contrast can be varied to obtain optimal image quality through change of development electrode bias and spacing between development electrode and plate. Higher electrode bias reduces enhancement and deletion width at the expense of broad area contrast. Small electrode-to-plate gap increases broad area contrast, but diminishes edge enhancement and deletion. Factors affecting image density include development time and solids concentration in the developer. Spatial resolution in excess of 20 cycles/mm have been demonstrated with liquid developers. A set of development parameters consisting of electrode bias, electrode-to-plate gap, development time and toner concentration which has produced xeroradiographic images of excellent diagnostic quality are as follows:

Electrode bias: 1600 volts, positive.

Electro-to-plate gap: 0.050 inches, or 0.127 cm

Development time: 2 seconds.

Toner concentration: 0.35 Optical Density Units/mm.

A pump 314, driven by motor 313, removes developer from reservoir 316 and continually recirculates it through the container 302 via ducts 320, 322, 324 and 326 as illustrated. The liquid flow over the development electrode is laminar, thus having the appearance of a standing wave. Image development is accomplished by traversing the plate 150 at a constant velocity through the standing wave. Development time, it should be noted, can be varied with plate velocity. Since the toner particles must be uniformly suspended in the liquid (forming the developer), constant stirring of the developer is required and is provided in the following manner. A portion 330 of the developer flow is diverted back to the reservoir 316 via duct 331 and past electro-optical sensor 332, the resultant flow 334 stirring the toner developer in the reservoir 316. To achieve consistent image density, the solids in the toner developer carried out by the developed plates have to be replenished. This is done automatically with a closed loop concentration control system. In particular, the optical density of the developer fluid 330 is continually measured electrooptically via sensor 332 and compared against a set, predetermined reference value. When the fluid density declines below the predetermined level, an electric impulse, amplified by amplifier 336, opens solenoid valve 338, valve 338 controlling a concentrate reservoir 340, thereby allowing concentrate to flow along path 342 into the developer in reservoir 316.

Liquid development of xeroradiographic dental images and tape transfer of the toner image created the process requirement of image drying prior to transfer.

Drying a xeroradiographic image in the dental application requires that the image fidelity be preserved (i.e., toner image must not be disturbed); drying marks, similar to the edges of an evaporated water drop, should not appear anywhere in the image area; and drying must occur "on the fly" to achieve the overall system throughput goals.

Figure 5A:
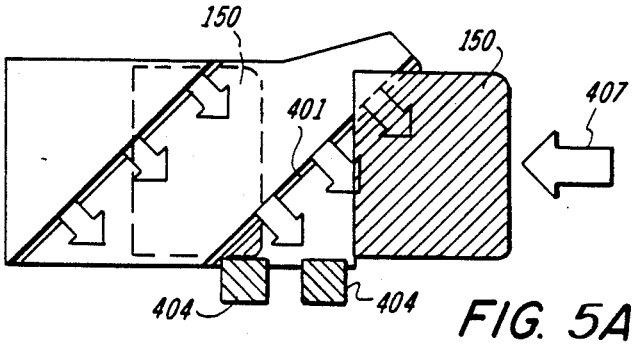
FIGS. 5A and 5B illustrate the drying station.
Figure 5B:
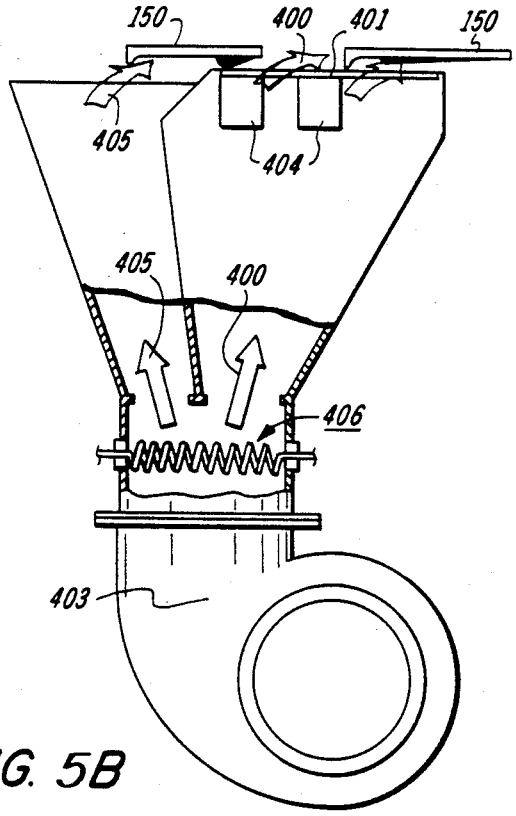

A two-step drying method which meets all three requirements is shown in FIGS. 5A and 5B. To remove the excess developer fluid the image bearing photoreceptor 150 is moved over a stationary airknife. The airknife comprises a gentle stream of slightly pressured and heated air 400 coming out of a slot-like orifice 401 generated by airsource (blower) 403, the fluid being forced to the side of the photoreceptor 150 where it is either flicked off or absorbed by felt or foam pads or rolls 404. The squeeging beam of air is angled to the photoreceptor 150 as shown (preferably at an angle of 45°). Once the photoreceptor member 150 has passed the airknife, the toner image is still slighly moist. The final drying is accomplished by means of evaporation. A large volume of the heated air 405 is blown towards the image causing the toner particles and the photoreceptor surface to dry. The direction of the drying air flow is also angled to the plate path to keep any drops that might be forming at the side of the absorbing pads 404. As shown in the figure, resistive heater means 406 are provided to heat the air produced by blower 403. Plates 150 are, as illustrated, driven in the direction of arrow 407.

Figure 6:
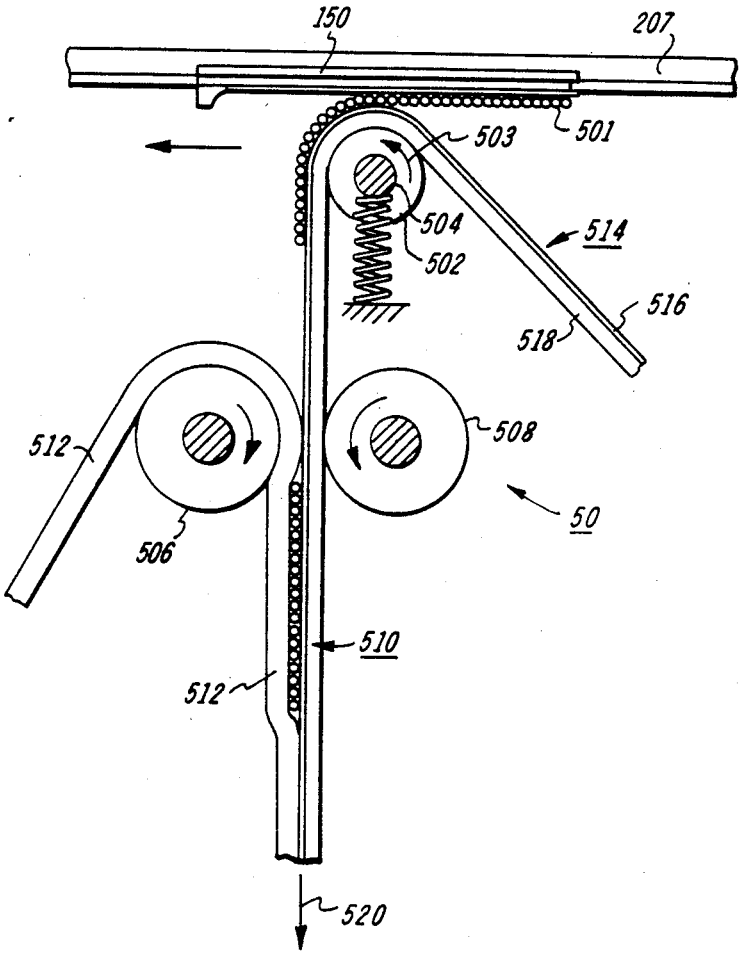
FIG. 6 is a general schematic view of the transfer station.

FIG. 6 is a simplified schematic drawing of the transfer process utilized in the present invention to transfer the toner image from the surface of the photocondutive member 150 to a receiving surface and thereafter to form a layered structure comprised of a translucent backing strip, the transferred toner image and an adhesive member.

Specifically, the photoconductive member 150 is pushed along the plate track 207 by the pushing mechanism in a continuous manner into the transfer station 50. The toner image 501 formed on the surface of the photoconductive member 150 faces a transfer pressure roll 502 which is a non-driven idler roll, rotatable in the direction of arrow 503 about shaft 504. As illustrated, transfer pressure roll 502 is, in the operative state, spring biased towards the toner image 501. If a new material cartridge is to be inserted into the transfer station, the operator (by a mechanism described hereinafter) can move the transfer pressure roll 502 away from the toner image 501. A drive roll 506 and pinch roll 508 are also provided both of which are driven in the direction of the arrows. The components of the layered structure 510 referred to hereinabove comprises translucent backing strip 512 and an adhesive film member 514, the adhesive film member 514 comprising transparent adhesive portion 516 and transparent film portion 518.

In operation, with transfer pressure roll 502 in the position shown, the toner image 501 is stripped from the surface of the photoconductive member 150 and adheres to clear adhesive portion 516. As the toner containing adhesive film member 514 is driven in the direction of arrow 520 by the combined action of drive roll 506 and pinch roll 508, translucent backing strip member 512 is fed into the space between roll 506 and the toner containing surface of adhesive portion 516. The force maintained between the rolls 506 and 508 adheres the backing strip 512 to the adhesive film member 514, forming a laminated image therebetween.

Adhesive portion 516 is rolled onto the image with moderate pressure, thus trapping the toner particles. The pressure exerted by the transfer roll 502 and the adhesive penetrating the toner layers makes toner layers adhere together. With the top layer firmly held by the tape adhesive portion 514, virtually all toner is lifted off the plate surface when the adhesive film member 514 is removed therefrom. Because of the tackiness of the adhesive film portion 514 any relative motion between the tape and plate is prevented, image fidelity being fully preserved.

To permanently fix the image, the adhesive side is laminated to the white, grain-free plastic backing strip 512. The lamination process sandwiches the toner image between two durable, scratch resistant strips thus assuring archival quality. The backing strip, being a white, translucent material, allows viewing of the image in reflected or transmitted light, a convenience to the machine operator and the patient. Transfer and lamination is a dynamic process synchronized with plate velocity. Thus, while the second image is being transferred, the first image is laminated as illustrated in the figure. Since the tape is still sufficiently tacky while carrying the toner image, lamination is parctically irreversible. After lamination, a single image or a strip of images is cut off automatically by the operator pushing a button which activates a cutting mechanism.

Backing strip 512 is preferably a polyester film coated with a white material (such as titanium dioxide bound in plastic) having a thickness typically in the range of from 0.0005–0.006 inches or 0.0125–0.0150 cm thick. A typical material which may be used is Stabilene Opaque Film, manufactured by Keuffel and Esser, Morristown, N.J. Transfer film portion 518 of film member 514 preferably comprises an intermediate layer of clear, stable plastic film having a thickness typically in the range from 0.001–0.003 inches or 0.0025–0.0075 cm thick, such as DuPont's Mylar D plastic film. Transparent adhesive portion 516 is coated on one side of film 518 and preferably comprises an acrylic adhesive layer approximately 0.002 inches or 0.005 cm thick. The other side of film 518 is coated with a very thin layer of a silicone release material (not shown in the figure) to prevent the inner wound layers of film member 514 from sticking together.

Figure 7:
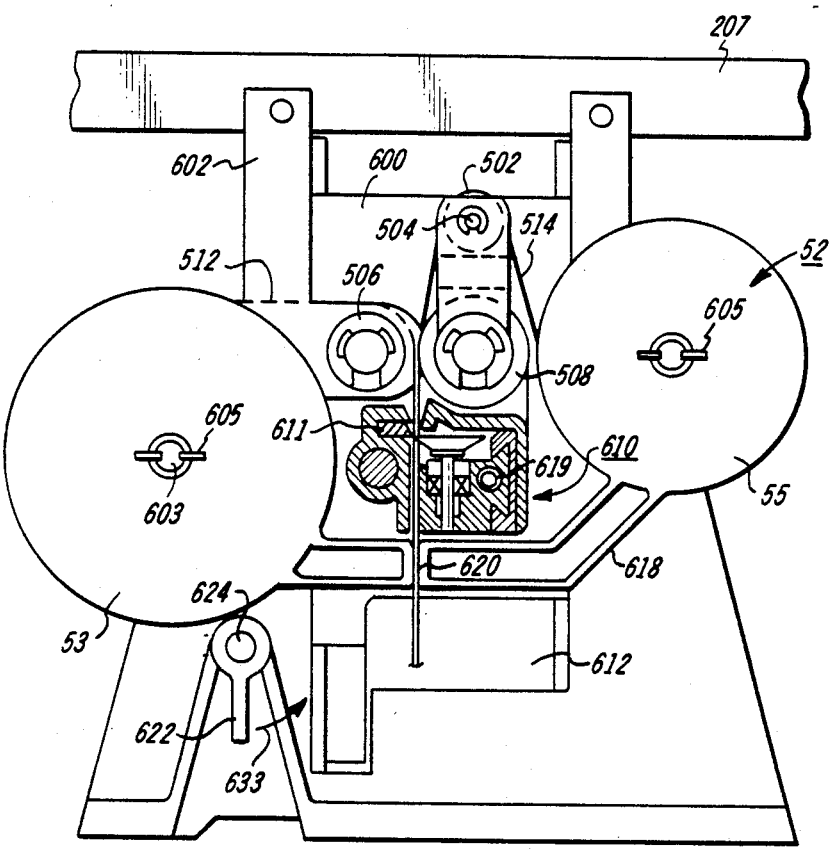
FIGS. 7 and 8 are plan views of the front and rear, respectively, of the transfer and cutting station in the down position.
Figure 8:
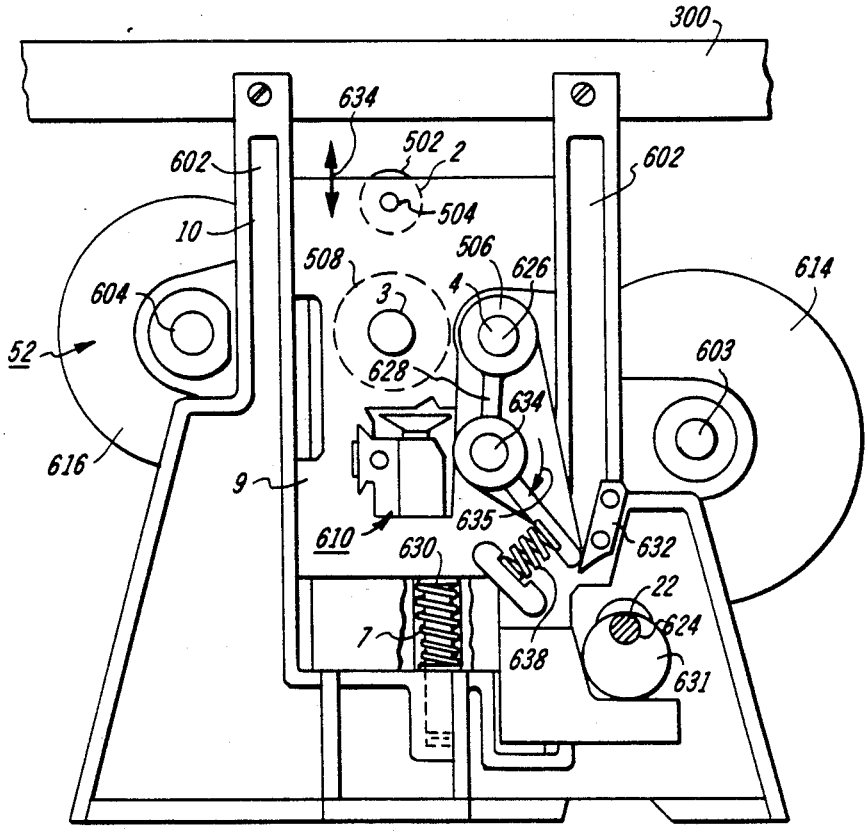

FIGS. 7 and 8 show front and rear elevation views, respectively, of the transfer station 50 in the down, or inoperative position. Transfer station 50 includes means for locating and then locking a dental tape cartridge 52 in place and a mechanism for bringing the transfer pressure roll 502 into operative contact with the toner image formed on the surface of the photoconductive plate member which is being driven to the transfer station 50 along plate track 207.

The apparatus comprises a tape transfer slide assembly 600 shown positioned within a slide support 602. Locating pins 603 and 604, formed on slide assembly 600, are provided to properly locate the cartridge assembly 52 loaded with the backing tape 512 and transfer tape 514 when placed on slide assembly 600. Locking springs 605 (associated pins not being shown) enables the cartridge assembly to be locked into place after it is positioned on the locating pins 603 and 604. Drive roll 506, pinch roll 508 and transfer pressure roll 502 are affixed to the tape transfer slide assembly 600. A knife assembly 610, including a fixed knife 611, described in more detail hereinafter, allows the laminated images to be cut individually or in strips, the cut image being caught in area 112. The cartridge 52 comprises a unitary structure having storage compartments 53 and 55 for backing tape 512 and transfer tape 514, respectively, the two storage compartments being joined by an elongated portion 618. An aperture 620 for directing the laminated image into catch area 110 is provided in portion 618 as illustrated. A lever 622, rotatable about shaft 624, is provided to move transfer tape 502 into and out of engagement with laminated tape as appropriate and to facilitate loading of a new cartridge. Transfer roll shaft 504 is utilized to rotatably support transfer pressure roll 502 and pivoted pinch roll shaft 626 is utilized to pivotably support drive roll 506. A pivot mechanism 628 is mechanically coupled to drive roll shaft 626. A transfer load spring 630 is provided to maintain the transfer slide assembly 600 at a predetermined position (and therefore the transfer pressure roll 502) such that the toner image can be transferred to the adhesive layer 514. Driven pinch roll shaft 626 is affixed to slide assembly 600 and is utilized to mount the drive roll 506. An eccentric cam member 631 and linear cam member 632 provide the required mechanical action for driving the slide assembly 600 in the direction of arrows 634. A compression spring 638 compresses (holds together) drive and pinch rolls 506 and 508, respectively, in the operative mode.

In operation, and assuming that a cartridge assembly is to be loaded into the system transfer station, the operator turns lever 622 which disengages drive roll 506 so that a leader of laminated transfer and backing tape (each tape already in place in their respective compartments) can be threaded over the transfer roll and between drive and pinch roll and then places the cartridge 52 on locating pins 603 and 604 and presses it towards slide assembly 600 to lock the cartridge assembly 52 in place. It should be noted that the cartridge assembly 52 is supplied to the system user as required. The leader (standard) preferably is added to leading edges of transfer and backing tape by the supplier. Cam member 632 is then positioned in the direction of arrow 633, thereby causing cam member 630 and spring 626 to move slide assembly 600 in the direction of arrow 634 to a predetermined position so that transfer pressure roll 502 is adjacent the toner image formed on the surface of the photoconductive member. If the cartridge 52 is to be removed; i.e., the tape therein has been deleted, cam member 632 is moved in the direction opposite to arrow 633, causing the slide assembly 600 to be retracted to an initial, or unloaded position.

Spring 630 is biased to push slide assembly 600 towards the plate path in the operating mode. If it is desired to replace the cartridge assembly 52 already in place, lever 622 on cam 630 is rotated causing cam 630 in turn to rotate 180° thereby moving slide 600 downwards and pivots against cam 632 causing pivot 634 to rotate in the direction of arrow 635 thus separating rolls 506 and 508, lowering transfer roll 502 and allowing the leader of laminated tape in cartridge 52 to be placed over transfer roll 502 and between drive and pinch rolls 506 and 508. It should be noted that as the cartridge 52 is pushed forward over the locating pins 603 and 604, the tapes are lifted enough to form a loop allowing them to be positioned over the transfer roll 502 and rolls 506 and 508.

While the invention has been described with reference to specific embodiments, it will be understood by those skilled in the art that various changes may be made and equivalents substututed for elements thereof without departing from the true spirit and scope of the invention. In addition, many modifications may be made without departing from the esential teachings of the invention.

What is claimed is:

1. A xerographic system which uses toner to produce a plurality of images from a single exposure of a xerographic plate comprising, a development station for applying toner to create an image thereon, a transfer station for transferring said image from said plate onto a surface, and means for transporting the plate a plurality of times over said development and transfer stations to create a plurality of images.

2. The system of claim 1 wherein said toner is liquid toner, and wherein said system further comprises a drying station between said development and transfer stations for drying said liquid toner before transfer to said surface.

3. The system of claim 2 wherein said surface is a film.

4. A xerographic system which uses toner to produce a plurality of images from a single exposure of a xerographic plate comprising, a plurality of development stations for applying toner to an exposed plate to create an image thereon, a plurality of tranfer stations for transferring said image onto a surface, and means for transporting the plate alternately over said development and transfer stations to create a plurality of images.

5. The system of claim 3 wherein said toner is liquid toner, and wherein said system further comprises a plurality of drying stations between said development and transfer stations for drying said liquid toner before transfer to said surface.

6. The system of claim 5 wherein said surface is a film.

* * * * *